US007970162B2

(12) United States Patent
Sumitani et al.

(10) Patent No.: US 7,970,162 B2
(45) Date of Patent: Jun. 28, 2011

(54) LOUDSPEAKER BOBBIN INTERCONNECTION ASSEMBLY

(75) Inventors: Yoichiro Sumitani, Rancho Palos Verdes, CA (US); Lin Chun-Yi, Xinzhuang (TW)

(73) Assignee: Sound Sources Technology, Inc.

( * ) Notice: Subject to any disclaimer, the term of this patent is extended or adjusted under 35 U.S.C. 154(b) by 1211 days.

(21) Appl. No.: 11/542,047

(22) Filed: Oct. 3, 2006

(65) Prior Publication Data

US 2008/0080736 A1 Apr. 3, 2008

(51) Int. Cl.
*H04R 1/00* (2006.01)
*H04R 9/06* (2006.01)
*H04R 11/02* (2006.01)

(52) U.S. Cl. ..... 381/407; 381/400

(58) Field of Classification Search ..... 381/396, 381/400, 403–405, 407, 412, 413, 423, 433; 181/164, 173

See application file for complete search history.

(56) References Cited

U.S. PATENT DOCUMENTS

| | | | |
|---|---|---|---|
| 3,407,273 | A | 10/1968 | Arnold |
| 4,118,605 | A | 10/1978 | Kobayashi et al. |
| 6,343,136 | B2 | 1/2002 | Tokusho et al. |
| 7,031,487 | B2 | 4/2006 | Stiles |
| 7,031,490 | B2 | 4/2006 | Stompler |
| 7,035,424 | B1 | 4/2006 | Brandt |
| 2002/0064294 | A1 | 5/2002 | Tokusho et al. |
| 2005/0185817 | A1 | 8/2005 | Stead et al. |

*Primary Examiner* — Tuan D Nguyen

(74) *Attorney, Agent, or Firm* — Stetina Brunda Garred & Brucker

(57) ABSTRACT

A bobbin interconnection assembly in a moving coil loudspeaker is disclosed. The assembly includes a first coupling member fixed to a central region of a diaphragm of the loudspeaker. The assembly also includes a second coupling member that may be removably engaged to the first coupling member. The second coupling member is fixed to an inner rim of an annular damper, and to a voice coil bobbin.

17 Claims, 8 Drawing Sheets

LOUDSPEAKER BOBBIN INTERCONNECTION ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention generally relates to acoustic transducers and manufacturing methods thereof. More particularly, the present invention relates to bobbin interconnects for loudspeakers, and methods for assembling loudspeakers utilizing the same.

2. Related Art

Loudspeakers are universally known and utilized in audio systems for the reproduction of sound. Essentially, loudspeakers are transducers which convert electrical energy to acoustic energy. There are a wide variety of designs employing various operational principles, and can be generally categorized as electrodynamic, electrostatic, piezoelectric, or discharge, among others.

The most common type of loudspeaker is of the electrodynamic variety, in which an electrical signal representative of the desired audio is applied to a voice coil wound around a bobbin and suspended between opposite poles of a magnet. The region between the poles is known as the air gap, and the magnetic field present therein interacts with the electrical current passed through the voice coil. The electromagnetic force moves the bobbin/voice coil along the air gap, and the displacement or movement thereof is controlled by the magnitude and direction of current in the coil and the resulting axial forces. The bobbin is also attached to a cone-shaped semi-rigid diaphragm, and the vibration of the bobbin is correspondingly transferred thereto. The base of the diaphragm is generally suspended from the rim of the loudspeaker basket, and provides lateral stability. The apex of the diaphragm generally includes a damper, also known in the art as a spider, a ring-shaped member having an interior edge that may be glued to the bobbin and an exterior edge that may be glued to the basket. The damper resiliently supports the bobbin at the respective predetermined static positions within the air gap without the voice coil contacting the surrounding surfaces of the yoke or the magnet.

In conventional loudspeakers, the aforementioned components are typically all adhered to each other with an adhesive agent, such as glue. For instance, the diaphragm defines a hole at the apex thereof, and is configured to receive the hollow cylindrical bobbin. The bobbin may then be glued or otherwise adhered to the diaphragm. In order to cover the hole in the diaphragm and the bobbin, a dust cap may be affixed. The base of the diaphragm is typically glued to the suspension, which in turn is also glued to rim of the basket. The damper is similarly glued to the basket, as well as to the bobbin.

As will be appreciated, such adhesive-based construction is substantially irreversible, that is, the replacement of individual components within the loudspeaker becomes difficult to accomplish without damaging other connected components. Accordingly, there is a need in the art for an improved loudspeaker bobbin interconnection assembly that minimizes the use of adhesive agents between major components. Further, there is a need in the art for loudspeakers comprised of modular, replaceable components that are readily engageable to and disengageable from each other.

BRIEF SUMMARY

In accordance with the present invention, there is provided in a loudspeaker an assembly for coupling a diaphragm and a damper to a voice coil bobbin. The assembly may include a diaphragm holder that is defined by an annular connecting portion and a flange portion. The annular connecting portion may include a first linking member, and the flange portion may define a concave surface conforming to the surface of the diaphragm. Further, the assembly may include a bobbin collar defining a second linking member. Such second coupling member may be engageable to the first linking member. The bobbin collar may be mountable to the voice coil bobbin and to the damper. In another aspect, the bobbin collar may be co-molded with the damper. The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention. It is further understood that the use of relational terms such as first and second, top and bottom, and the like are used solely to distinguish one from another entity without necessarily requiring or implying any actual such relationship or order between such entities.

Figure 1:
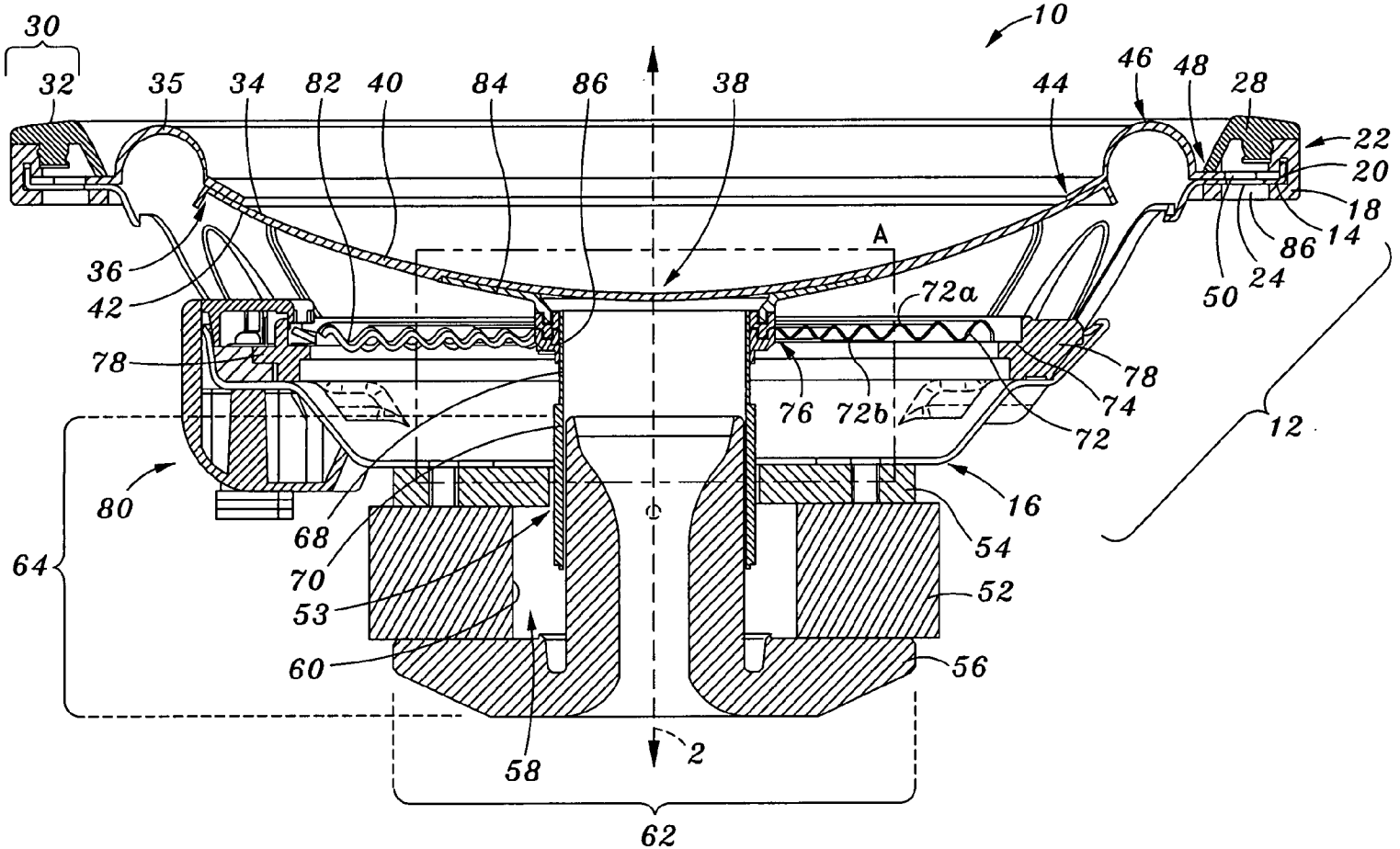
FIG. 1 is a cross-sectional view of an embodiment of a loudspeaker with a bobbin interconnection assembly in accordance with an aspect of the present invention.

With reference to the cross-sectional view of FIG. 1, a preferred embodiment of a moving coil loudspeaker 10 in accordance with an aspect of the present invention is illustrated. The loudspeaker 10 is generally comprised of a basket 12 having a front rim 14 and a basket base 16, and is coaxial with the central axis 2. The basket 12 is otherwise known in the art as a frame, and the two terms are deemed to be interchangeable. Generally, the basket 12 is circularly shaped, although the present invention need not be limited thereto. It will be appreciated the basket 12 may have other shapes, such as an oval shape, without departing from the scope of the present invention. Along these lines, when referring to a feature of the present invention having a "circular" shape hereinbelow, one of ordinary skill in the art will recognize that such feature may have an alternative shape as indicated above.

The front rim 14 has attached thereto an annular reinforcement member 18. Further, the front rim 14 may define a lip 20, to which a vertical fitting portion 22 of the reinforcement member 18 may be wrapped around. The reinforcement member 18 is constructed of a resiliently flexible material such as rubber for this purpose. The front rim 14 defines one or more mounting holes 24, and the reinforcement member 18 in likewise fashion defines one or more mounting holes 26. It will be understood that one or more fastening members (not shown) may be inserted through the mounting holes 24, 26 to mount the basket 12 and the reinforcement member 18 to an enclosure or other structure.

For enhancing the decorative appearance of the face of the loudspeaker 10, there is provided a grille 28 having an annular body 30. The grille 28 may include a mesh-like element that covers the entire face of the loudspeaker 10, but as understood in the art, the grille 28 need not include such an element, and any decorative piece attached to the front rim 14 may be so referenced. The body 30 typically includes a facade 32 that includes ornamental designs that are engraved, painted, or otherwise impressed thereupon. In addition to its decorative functions, the grille 28 serves to cover the mounting holes 24, 26 and any fastening members (not shown) inserted therethrough to mount the loudspeaker 10 to an enclosure or other structure.

The loudspeaker 10 further includes a diaphragm 34 mounted to the front rim 14 via an annular surround 35. As indicated above, the diaphragm 34 is also known in the art as a cone, and the following description will refer to parts of the diaphragm 34 using terms commonly associated with a geometrically conical structure. The diaphragm 34 is defined by a base edge 36, and an apex 38, and is generally partially spherical in shape. The front face 40 of the diaphragm 34 is characterized by a concave surface, while the opposing back face 42 is characterized by a convex surface. As will be recognized by one of ordinary skill in the art, the diaphragm may be constructed of paper, polypropylene, carbon-fiber composite material, Kevlar, or any other material suitable for acoustic applications.

The annular surround 35 is characterized by a diaphragm attachment portion 44, a central flexing portion 46, and a rim attachment portion 48. The diaphragm attachment portion 44 is slightly angled with respect to the orientation of the rim attachment portion 48, and accommodates the partial spherical contour of the diaphragm 34. While in the exemplary embodiment the diaphragm 34 is adhesively attached to the diaphragm attachment portion 44, any other well known diaphragm-surround junction may be readily substituted without departing from the present invention. For example, the surround 35 may be co-molded with the diaphragm 34. The central flexing portion 46 has a semi-circular cross section that contracts and expands in conjunction with the reciprocating motion of the diaphragm along the central axis 2. In this regard, the annular surround 35 provides lateral stability and limits the range of motion of the diaphragm 34 to prevent damage to the loudspeaker 10. While the diaphragm 34 is constructed of relatively rigid material as indicated above, the surround 35 is constructed of a softer and more flexible material, such as foam rubber. The rim attachment portion 48 is generally flat, and extends in a co-planar relationship to the front rim 14. With additional reference to FIG. 6, to accommodate any fastening members inserted through the mounting holes 24, 26 of the front rim 14 and grille 28, respectively, the rim attachment portion 48 includes one or more notches 50.

The loudspeaker 10 further includes a ring-shaped permanent magnet 52 disposed between a top plate 54 and a t-shaped yoke 56. The magnet 52 defines a central circular opening 58, defined by the inner surface 60 of the magnet 52. The yoke 56 includes a flange portion 62 and a cylindrical portion 64 oriented perpendicularly thereto. The cylindrical portion 64 extends through the central circular opening 58 of the magnet 52, and in conjunction with the top plate 54, defines an air gap 53. The cylindrical portion 64 may also include a vent port 66 that is coaxial with the cylindrical portion 64 and the central axis 2. The air gap 53 is cylindrical, that is, it conforms to the cylindrical portion 64 and the central circular opening 58. It will be understood by those having ordinary skill in the art that the aforementioned components may be attached or otherwise fixed to the basket 12 according to any well-known technique.

The air gap 53 is cylindrical in order to accommodate the cylindrical configuration of the bobbin 68. The bobbin 68 is positioned such that a voice coil 70 disposed thereon rests within the air gap 53. The voice coil 70 is a coil of lightweight wire wrapped around the bobbin 68 and has one or more lead lines connected to an electrical current/audio source. As is well known, the current transmitted through the voice coil 70 induces an electromagnetic field, and by interacting with the magnetic field present in the air gap generated by the permanent magnet 52, the bobbin 68 reciprocates along the central axis 2. The bobbin 68 is mounted to the diaphragm 34, and also to a damper 72. Further details of the interconnection assembly relating to such components will be discussed in further detail below.

As indicated above, lateral stability of the bobbin 68 is further enhanced by the damper 72. The damper 72 is annular and is corrugated, that is, it is comprised of a series of concentric ridges 72*a* and peaks 72*b*, permitting the same to flex along the central axis 2. The damper 72 is constructed of a rigid woven fabric, giving it a degree of resiliency. Along these lines, the damper 72 defines an outer rim 74 fixed to the basket 12, and an inner rim 76 for attachment to the bobbin 68. In the preferred embodiment illustrated in FIG. 1, the damper 72 is fixed to a damper ring 78, which is then attached to the basket 12.

Figure 7:
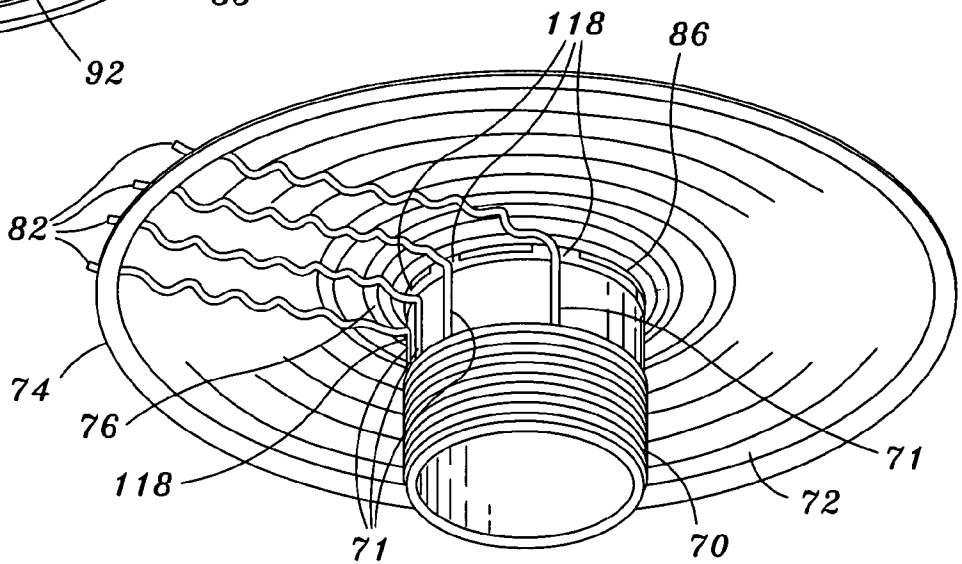
FIG. 7 is a perspective view of a damper and a voice coil bobbin attached to the bobbin collar.

The electrical current/audio source is connected to the loudspeaker 10 via a terminal 80 attached to the basket 12. It will be appreciated by one of ordinary skill in the art that any suitable terminal type may be utilized, including banana plug receptacles, bare wire clips, and so forth. Generally, as is the case with the illustrative embodiment, the terminal 80 is disposed on the outer periphery of the basket 12, while the voice coil 70 is disposed in the central region of the same. To transfer the electrical current from the terminal 80 to the voice coil 70, there are one or more connecting wires 82 extending therebetween. More specifically as illustrated in FIG. 7, the connecting wires 82 are contoured to the ridges 72*a* and peaks 72*b* of the damper 72, and extend from the outer rim 74 to the inner rim 76, and are attached to lead lines 71 of the voice coil 70. Considering that the damper 72 undergoes significant flexing and vibration, the connecting wires 82 are preferably of the braided type, as opposed to solid wires. In the exemplary embodiment shown in FIG. 7, there are a pair of voice coils 70 wound around the bobbin 68, and there are two lead lines 71 associated with each one of the pair of voice coils 70.

Figure 2:
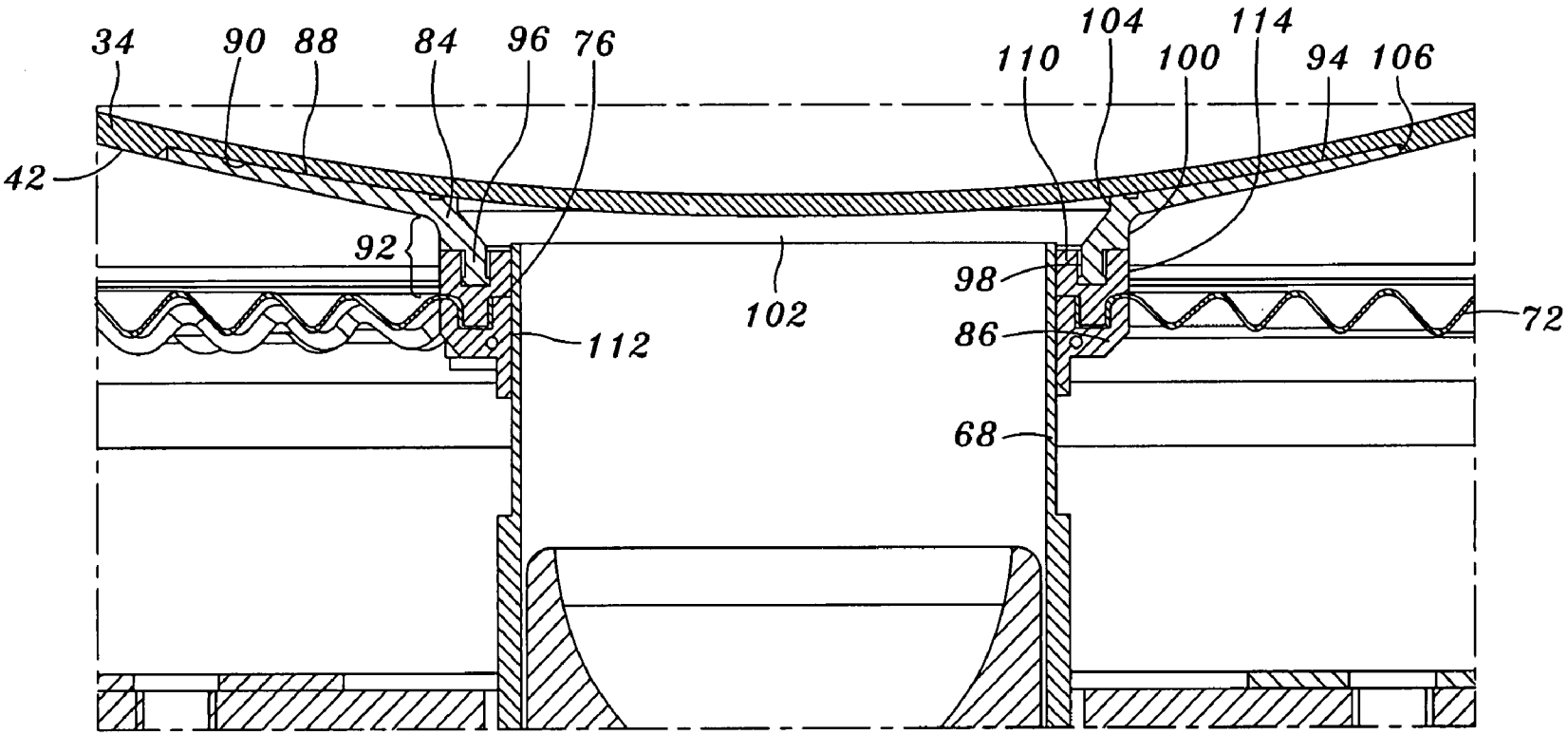
FIG. 2 is a detailed cross-sectional view of the bobbin interconnection assembly shown in area A of FIG. 1.

FIG. 2 is an enlarged view of the loudspeaker 10 in area A of FIG. 1, and further details relating to one embodiment of the present invention will be discussed with additional reference thereto. According to an aspect of the present invention, the loudspeaker 10 includes a first coupling member 86 fixed to the diaphragm 34 and removably engaged to a second coupling member 86. The inner rim 76 of the damper 72 and the bobbin 68 are also fixed to the second coupling member 84. As additionally illustrated in FIG. 6, the back face 42 of the diaphragm 34 defines a central indentation 88 that has a convex surface. The center axis of the indentation 88 is understood be co-axial with the central axis 2. The first coupling member 84 is positioned within the central indentation 88, and defines a concave surface 90 in a mating relationship with the convex back face 42.

Figure 3:
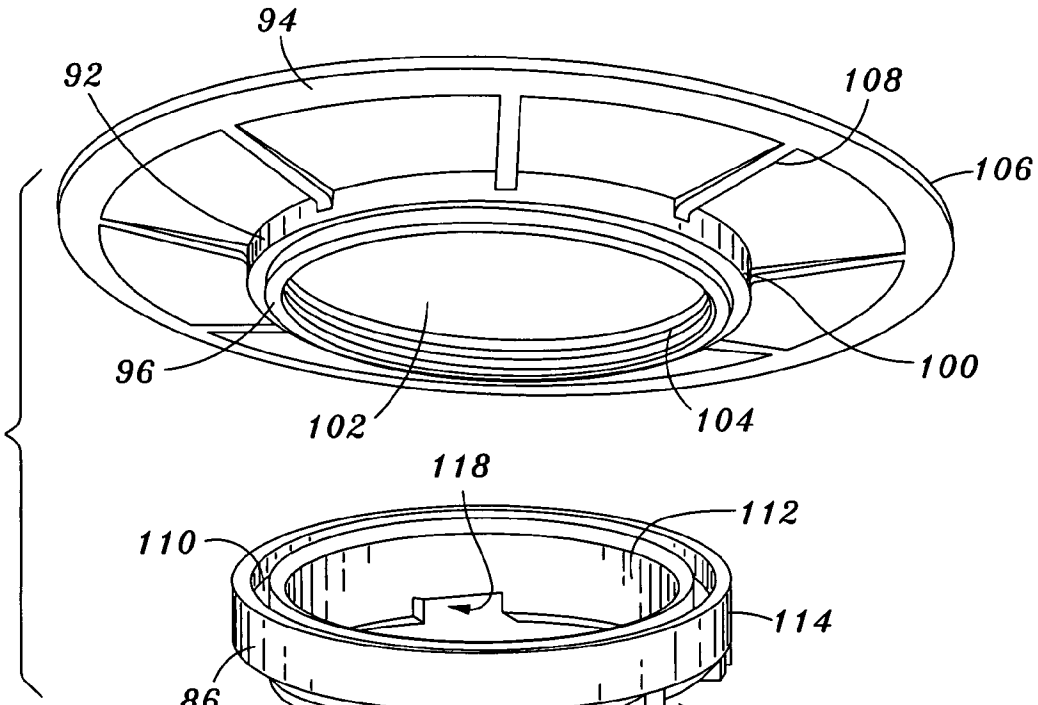
FIG. 3 is an exploded perspective view of a bobbin interconnection assembly divided into a diaphragm holder and a bobbin collar.
Figure 6:
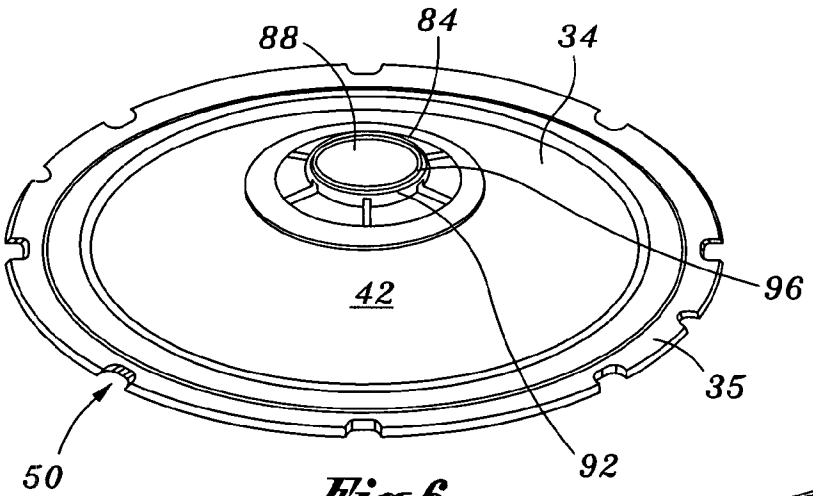
FIG. 6 is a perspective view of the diaphragm holder attached to a back face of a diaphragm in accordance with an aspect of the present invention.

More particularly, with reference to FIGS. 2, 3 and 6, in a preferred embodiment the first coupling member 84 is also referred to as a diaphragm holder and the second coupling member 86 is also referred to as a bobbin collar. The diaphragm holder 84 is defined by an annular connecting portion 92 and a flange portion 94. The annular connecting portion 92 includes a first linking member 96, and the flange portion 94 defines the concave surface 90. Specifically, the annular connecting portion 92 is defined by an inner circumference 98 and an outer circumference 100, the inner circumference 98 being the boundary of a central opening 102. The first linking member 96 is intermediate the inner circumference 98 and the outer circumference 100, and extends around the rim of the annular connecting portion 92. Alternatively, the first coupling member may be co-extensive with the inner circumference 98.

Figure 4:
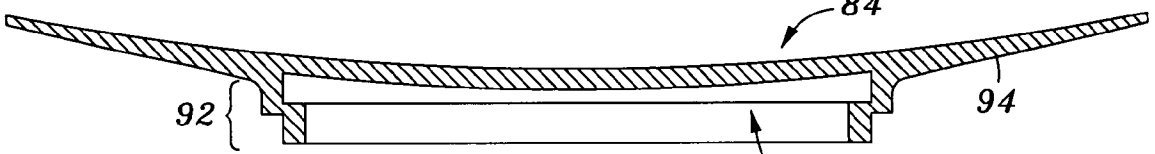
FIG. 4 is a detailed cross-sectional view of an alternative embodiment of the diaphragm holder.

In a preferred embodiment, the flange portion 94 does not cover the central opening 102, but in an alternative embodiment illustrated in FIG. 4, it is contemplated that the flange portion 94 extends across the central opening 102. In such an embodiment, the flange portion 94 may merely partially cover the central opening 102. With further regard to the flange portion 94, it is understood that upon attachment to the diaphragm 34, it is flush with the back face 42. Along these lines, the flange portion 94 is defined by an inner periphery 104 and an outer periphery 102. The inner periphery 104 is co-extensive with the inner circumference 98 of the annular connection portion 92. However, it is also understood that the inner periphery 104 need not define a straight vertical edge extending through the entirety of the diaphragm holder, and some portions may be inclined.

It is further contemplated that the flange portion 94 includes a plurality of reinforcement members 108 to reduce flexing and deformation of the diaphragm holder 84. More specifically, the reinforcement members 108 extend radially from the outer circumference 100 of the annular connecting portion 92, and towards the outer periphery 106 of the flange portion 94. According to an embodiment of the present invention, the reinforcement members 108 have a greater thickness toward the outer circumference 100 of the connection portion 92, and become gradually tapered. Thus, the reinforcement members 108 are wedge-shaped.

With reference to FIGS. 2 and 3, the bobbin collar 86 includes a second linking member 110 that is removably engaged to the first linking member 96. The bobbin collar 86 is mounted to the bobbin 68, and the damper 72 is also attached thereto. In further detail, the bobbin collar 86 is defined by an inside rim 112 and an outside rim 114, with the second linking member 110 being intermediate the inside rim 112 and the outside rim 114. The second linking member 110 encircles the entirety of the rim of the bobbin collar 86. The inside rim 112 is adjacent to the outside surface of the bobbin 68, with the bobbin collar 86 being adhered to the bobbin 68 with an adhesive agent such as glue. When the bobbin collar 86 and the diaphragm holder 84 are engaged to each other, it is understood that the outer circumference 100 of the annular connection portion 92 and the outside rim 114 are aligned.

As indicated above, the bobbin collar 86 is removably engaged to the diaphragm holder 84. More specifically, the first linking member 96 is frictionally retained by the second linking member 110. Alternatively, the second linking member 110 may be formed to have a slightly smaller width so that it may impart a gripping force upon the first linking member 96. To further enhance the grip of the second linking member 110, optionally, an adhesive agent may be applied thereto.

Figure 5:
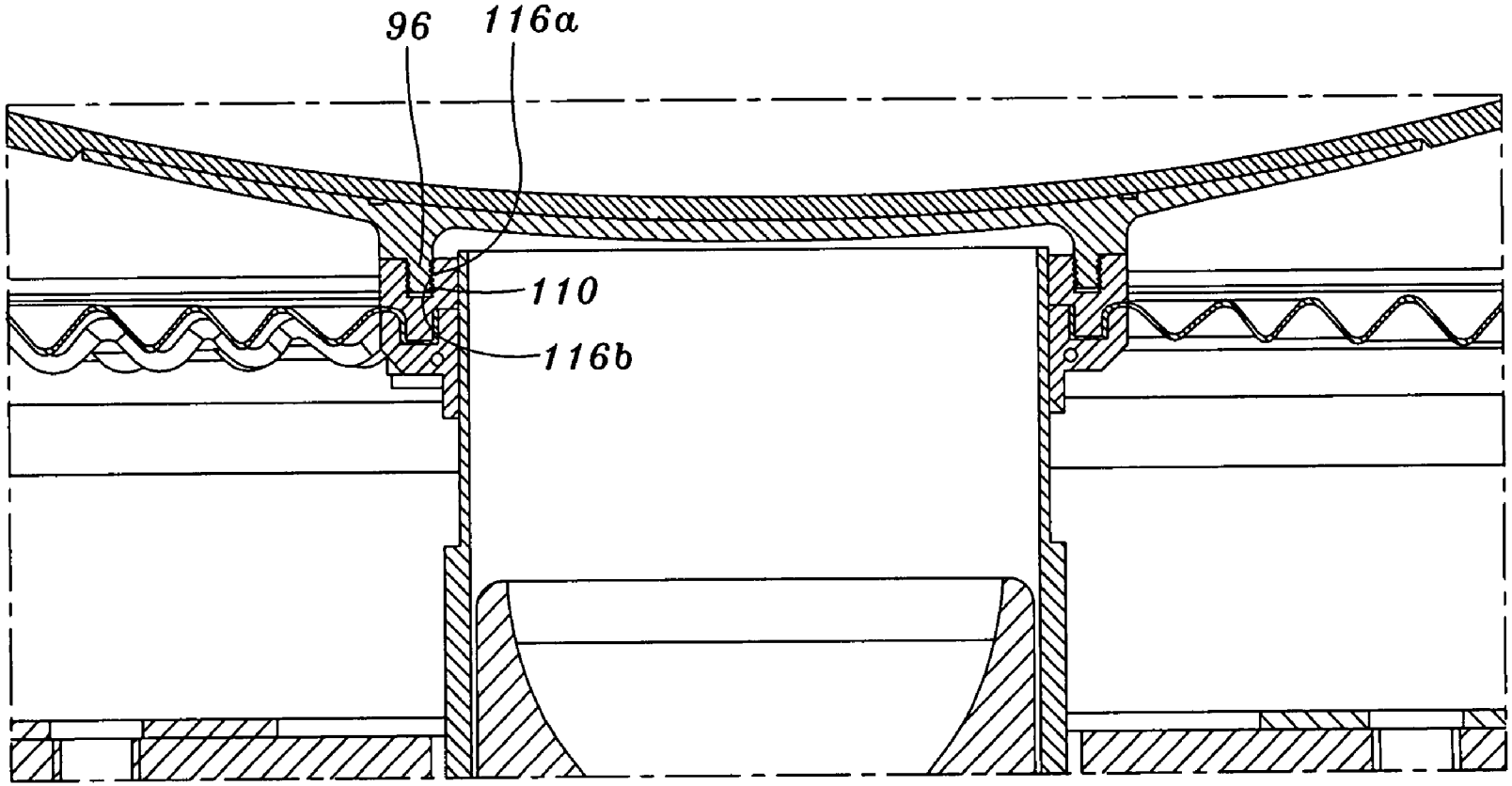
FIG. 5 is a detailed cross-sectional view of an alternative embodiment with helical grooves in linking members of the diaphragm holder and the bobbin collar.

Additional embodiments have also been contemplated as shown in FIG. 5. In this embodiment, the first linking member 96 includes a set of helical grooves 116*a* extending along the entire circumference thereof. Further, the second linking member 10 also includes a set of helical grooves 116*b* along the entire circumference thereof. It is envisioned that the helical grooves 116*a*, 116*b* enable a threadably engaged relationship between the first linking member 86 and the second linking member 110. In other words, the diaphragm holder 84 may be screwed onto the bobbin collar 86. Other connection means between the first linking member 96 and the second linking member 110 readily ascertainable by those having ordinary skill in the art may be substituted without departing from the scope of the present invention. Further, it is understood that while the exemplary embodiment discussed hereinbefore describes the second linking member 110 as receiving the first linking member 96, such a relationship may be reversed for the respective parts. That is, the first linking member 96 on the diaphragm holder 84 may be configured to receive a second linking member 110 on the bobbin collar 86.

Previously, it was mentioned that the damper 72 is fixed to the bobbin ring 86. In this regard, according to a preferred embodiment of the present invention, the bobbin ring 86 is co-molded with the damper 72. As shown in FIG. 2, the inner rim 76 is embedded within the bobbin collar 86. As will be appreciated by one of ordinary skill in the art, this eliminates the complexity of physically inserting the damper 72 into a slot formed within the bobbin ring 86. Along these lines, it is understood that the bobbin ring 86 and the diaphragm holder 84 are injection-molded with high-impact plastic. However, any suitable material for co-molding with the fabric damper 72 may be readily substituted without departing from the scope of the present invention.

Referring to FIGS. 3 and 7, the bobbin collar 86 includes one or more wire guide slots 118 for routing the connecting wires 82 to the lead lines 71 of the voice coil 70. With the connecting wires 82 being routed along the contours of the damper 72, a straight line path to the bobbin 68 following the plane of the damper 72 is obstructed by the bobbin collar 86. In other words, the connecting wires 82 must be routed around the bottom portions of the bobbin collar 86, subjecting the same to longitudinal bends. As will be appreciated, such bends are further weakened with repetitive vibration. It is contemplated that the wire guide slots 118 reduce the aforementioned problems because the connecting wires 82 are directly routed to the surface of the bobbin 68. Along these lines, each of the wire guide slots 118 are oriented in a parallel relationship with respect to each other, to eliminate the need for lateral bending around the cylindrical surface of the bobbin collar 86.

In accordance with another aspect of the present invention, there is provided a method for assembling a loudspeaker module of the diaphragm 34, the bobbin 68, and the damper 72. With reference FIGS. 8*a*-8*e* and 9, the assembly method begins with step 200 of assembling a diaphragm assembly 120. Specifically referring to FIG. 8*a*, it is understood that the diaphragm assembly 120 is comprised of the surround 35, the diaphragm 34, and the diaphragm holder 84. In further detail with respect to the method of assembly, the step 200 includes a sub-step 201 of pre-pressing the central indentation 88 on the diaphragm 34, follows by a sub-step 203 of attaching the suspension 35 to the diaphragm 34. This is followed by a sub-step 205 of attaching the diaphragm holder 84 to the diaphragm 34. The diaphragm holder 84 is positioned within the indentation 88, and glued or otherwise permanently adhered to the diaphragm 34.

Figure 8B:
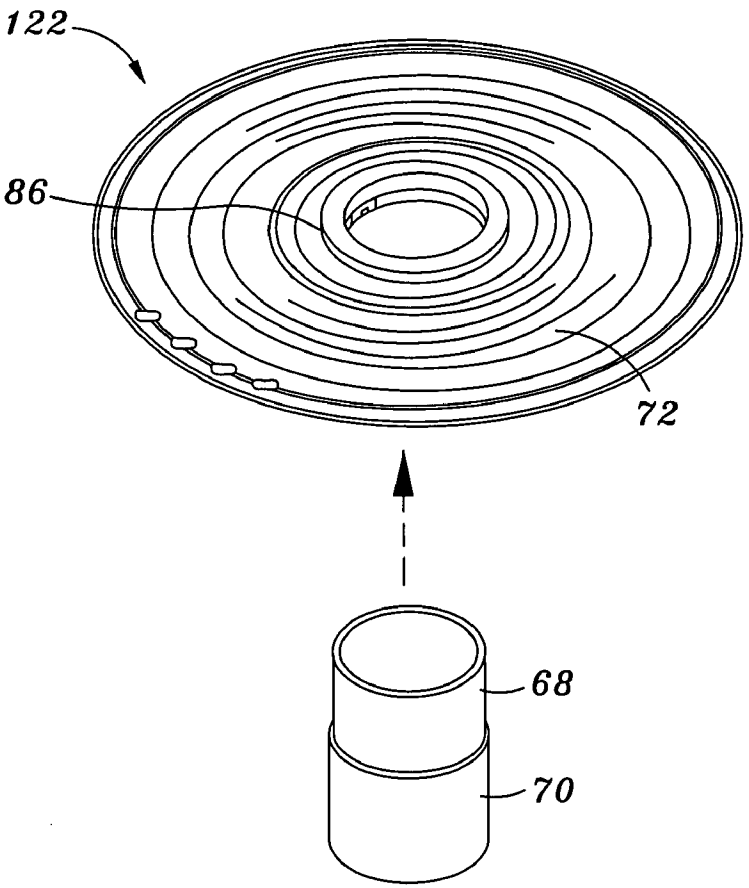
FIG. 8A-D are perspective views of the bobbin interconnection assembly in various states of assembly with respect to the other parts of the loudspeaker.
Figure 8A:
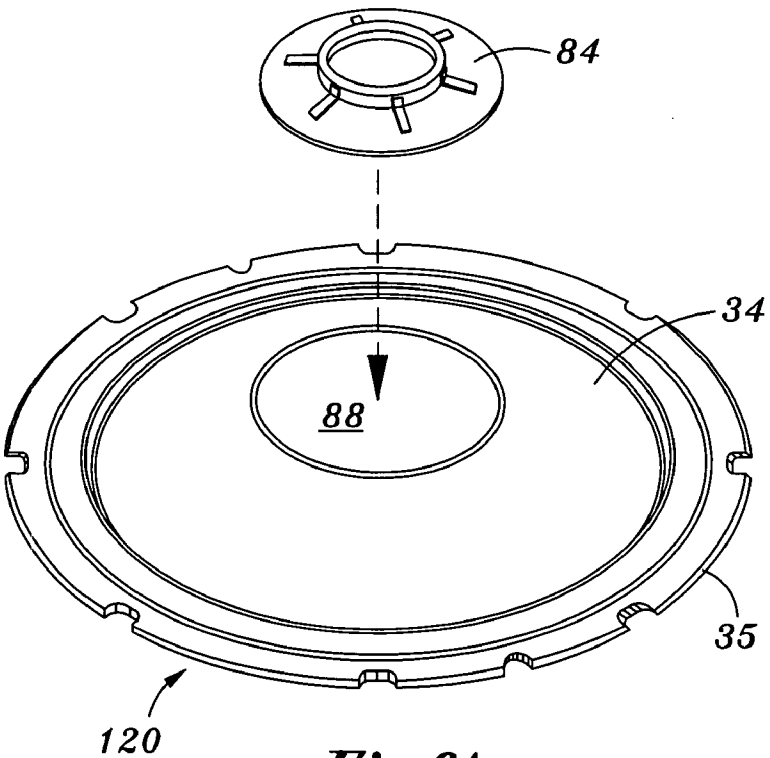
Figure 8D:
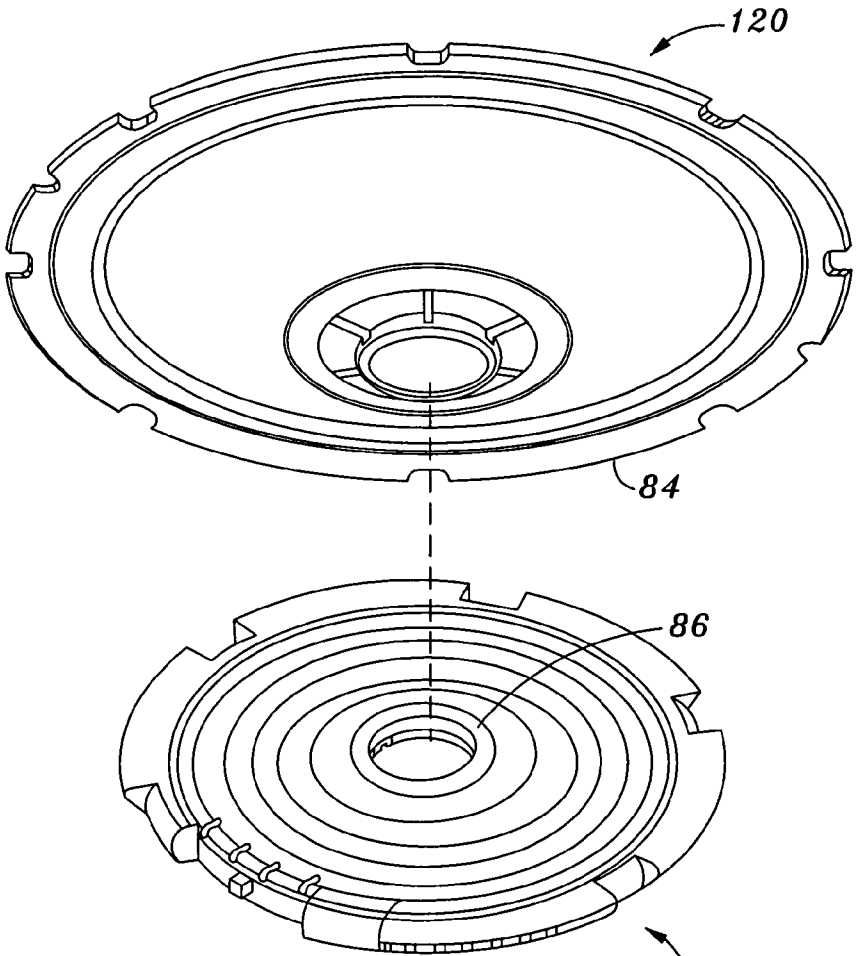
Figure 8C:
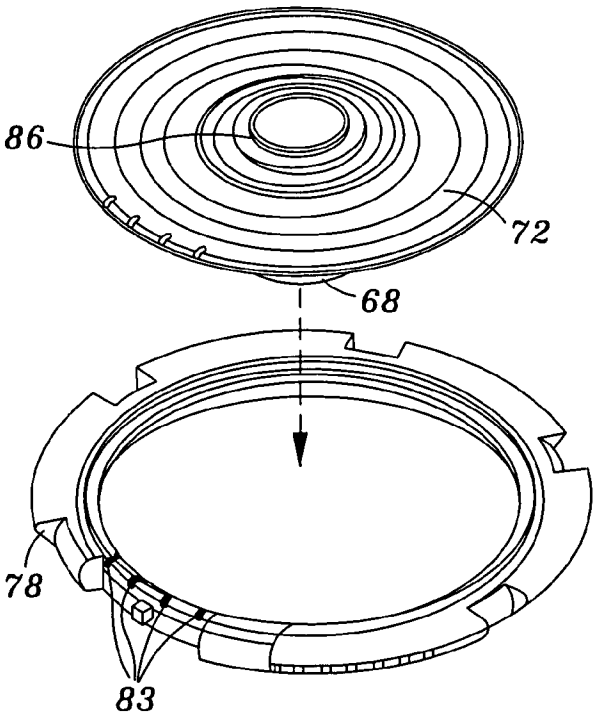

As shown in FIG. 8*b*, the bobbin collar 86 is co-molded with the damper 72, and according to step 210, a voice coil assembly 122 is constructed therewith. According to sub-step 211, the voice coil assembly 122 is constructed by co-molding the bobbin collar 86 with the damper 72. Thereafter, according to sub-step 213, the bobbin 68 is attached to the bobbin collar 86, resulting in the voice coil assembly 122. As indicated above in relation to FIG. 7, the connecting wires 82 extend across the damper 72 and are electrically connected to the lead lines 71 of the voice coil 70 per step 213. Optionally, as further illustrated in FIG. 8C, the voice coil assembly 122 may be attached to the damper ring 78 per step 215. It is understood that this step also includes electrically connecting the connecting wires 82 to metallic contacts 83 on the damper ring 78.

Figure 9:
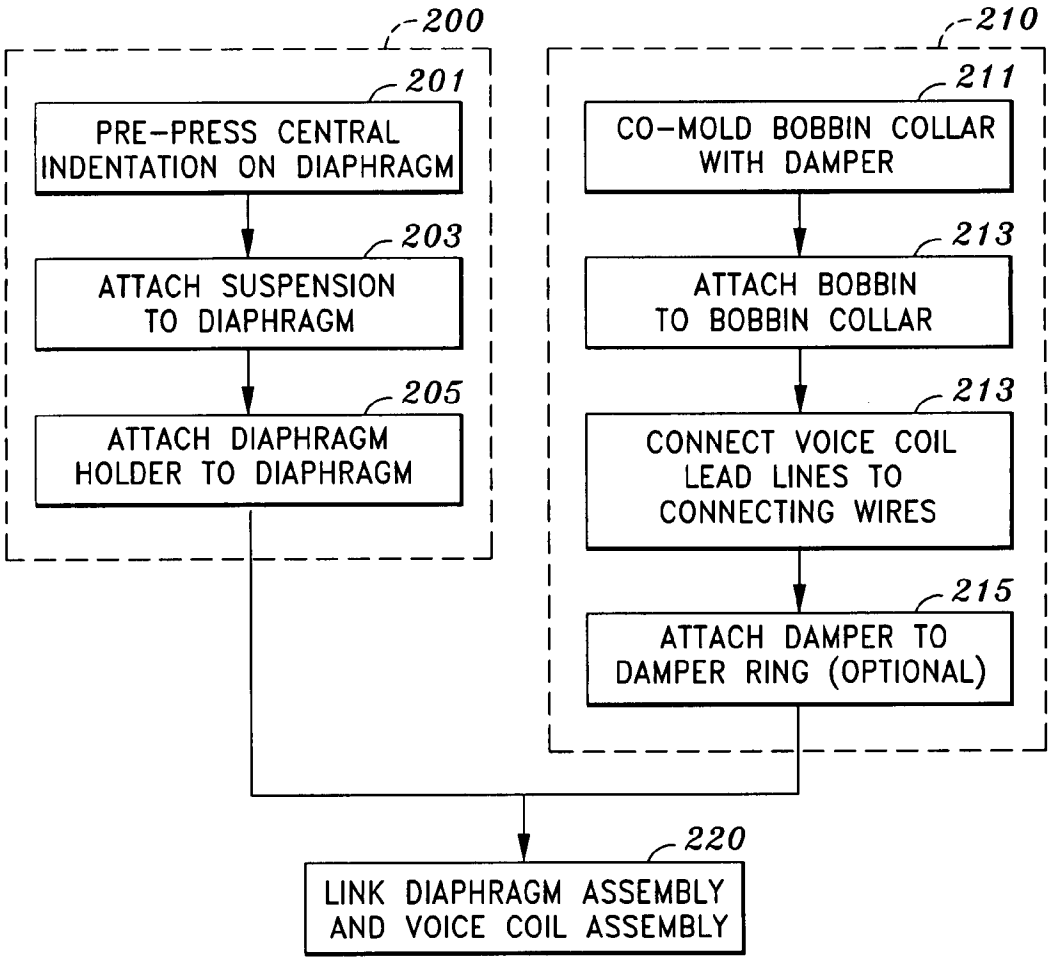
FIG. 9 is a flowchart describing the method of assembling the diaphragm, voice coil, and damper module of the loudspeaker utilizing the bobbin interconnection assembly.

With reference to FIG. 8 and FIG. 9, to complete the method of assembling the loudspeaker module per step 220, the bobbin collar 86 of the voice coil assembly 122 and the diaphragm holder 84 of the diaphragm assembly 120 are linked together. As indicated above, the respective linking members 96, 110 may have a variety of different configurations to effectuate this link. In this regard, it is understood that the assembly technique corresponds to such configurations.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. In a loudspeaker, an assembly for coupling a diaphragm and a damper to a voice coil bobbin, the apparatus comprising:

a diaphragm holder defined by an annular connecting portion and a flange portion, the annular connecting portion including a first linking member and the flange portion defining a concave surface conforming to the surface of the diaphragm; and a bobbin collar defining a second linking member engageable to the first linking member, the bobbin collar being mountable to the voice coil bobbin and to the damper;

wherein the annular connecting portion defines an inner circumference and an outer circumference, the first linking member being intermediate the inner circumference and the outer circumference, and the inner circumference defining a central opening.

2. The assembly of claim 1, wherein the flange portion is defined by an inner periphery and an outer periphery, the inner periphery of the flange portion being co-extensive with the inner circumference of the annular connecting portion.

3. The assembly of claim 1, wherein the flange portion at least partially covers the central opening.

4. The assembly of claim 1, wherein the bobbin collar defines an inside rim and an outside rim, the second linking member being intermediate the inside rim and the outside rim.

5. The assembly of claim 4, wherein the first linking member is an annular protuberance, and the second linking member is an annular recess, the second linking member being frictionally engageable to the first linking member.

6. The assembly of claim 5, wherein the annular protuberance and the annular recess each define helical grooves, the annular protuberance being threadably engageable to the annular recess.

7. The assembly of claim 1, wherein the bobbin collar defines at least one lead line slot.

8. The assembly of claim 1, further comprising a plurality of reinforcement members extending radially from the outer circumference of the annular connecting portion towards an outer periphery of the flange portion.

9. The assembly of claim 1, wherein the bobbin collar is co-molded with the damper.

10. A moving coil loudspeaker, comprising:

a frame having a front rim and a base;

a ring magnet defining a central circular opening;

a yoke extending through the central circular opening of the ring magnet and defining an air gap with a magnetic field therebetween;

a bobbin including a voice coil with at least a pair of lead lines connectable to a source to deliver an electrical current therethrough, the magnetic field interacting with the electrical current to produce an axial movement of the voice coil;

a diaphragm defined by a concave front face and a convex back face, the convex back face defining a central indentation;

an annular damper with an inner rim and an outer rim fixed to the frame;

a first coupling member fixed to the diaphragm within the central indentation thereof, the first coupling member defining a concave surface and being in a mating relationship with the convex back face of the diaphragm; and a second coupling member removably engaged to the first coupling member, the second coupling member being fixed to the inner rim of the annular damper and to the bobbin.

11. The loudspeaker of claim 10, further comprising a terminal disposed on the outer periphery of the frame, the terminal being electrically connected to the lead lines of the voice coil via connecting wires extending across the damper.

12. The loudspeaker of claim 11, wherein the second coupling member defines a first wire guide slot for routing the connecting wires to the lead lines of the voice coil in a substantially level orientation.

13. The loudspeaker of claim 11, wherein the second coupling member defines a second wire guide slot, the first wire guide slot being oriented in a parallel relationship with respect to the second wire guide slot.

14. The loudspeaker of claim 10, wherein the first coupling member is defined by a flange portion substantially flush with the diaphragm.

15. The loudspeaker of claim 10, wherein the second coupling member is co-molded with the annular damper.

16. The loudspeaker of claim 10, wherein the bobbin is glued to the second coupling member.

17. The loudspeaker of claim 10, further comprising a damper ring attached to an outer periphery of the frame, the outer rim of the damper being mounted to the damper ring.

* * * * *